US005544581A

United States Patent [19]

Haji

[11] Patent Number: 5,544,581

[45] Date of Patent: Aug. 13, 1996

[54] GARMENT SILKSCREENING APPARATUS

[76] Inventor: Abudulcadir A. Haji, 6814 F St., Capitol Heights, Md. 20743

[21] Appl. No.: 321,744

[22] Filed: Oct. 12, 1994

[51] Int. Cl.[6] ..... B05C 17/06

[52] U.S. Cl. ..... 101/126; 101/474

[58] Field of Search ..... 101/126 V, 474, 101/127, 114, 127.1, 128.4, 128.21, 128.1, 128, 401.1, 407.1, 123, 129, 124

[56] References Cited

U.S. PATENT DOCUMENTS

| | | | |
|---|---|---|---|
| 231,122 | 8/1880 | Underhill | 101/126 |
| 836,814 | 11/1906 | Klaczko | 101/126 |
| 1,508,116 | 9/1924 | Nantus | 101/126 |
| 3,244,093 | 4/1966 | Vasilantone | 101/126 |
| 5,188,034 | 2/1993 | Iaccino et al. | 101/126 |
| 5,321,868 | 6/1994 | Coulson et al. | 101/114 |

FOREIGN PATENT DOCUMENTS

| | | | |
|---|---|---|---|
| 0020728 | of 1912 | United Kingdom | 101/126 |
| 0481388 | 4/1938 | United Kingdom | 101/126 |

*Primary Examiner*—Edgar S. Burr
*Assistant Examiner*—Anthony H. Nguyen
*Attorney, Agent, or Firm*—Peter N. Lalos; Mark P. Watson; Lalos & Keegan

[57] ABSTRACT

An apparatus for silk screening a garment consisting of a base member, a support panel connected along one edge thereof to the base member, having a free end thereof receivable within an opening in the garment to position a portion of the garment on an upper surface of the support panel, and a silk screening member pivotly secured to the base member and swingable between an upper inoperative position and a lower operative position, having a silk screen portion adapted to overlie the garment portion disposed on the support panel when in the operative position.

13 Claims, 2 Drawing Sheets

GARMENT SILKSCREENING APPARATUS

This invention relates to a printing apparatus and more particularly to an apparatus for silk screening various designs and/or indicia on garments such as t-shirts and the like.

A popular fad, particularly among teenagers, is to wear certain garments such as t-shirts and the like displaying various designs and/or indicia such as emblems, caricatures, likenesses, slogans, quotations, commentary and the like corresponding to or commemorating some current event, interest, fad, occurrence, fashion, popular person or thing or other topic. Usually, such designs and indicia are created by various entrepreneurial persons, the garments are printed by commercial printing shops and the printed garments are marketed to the public by various retail stores and often by street vendors.

Because of the quick response time required to capitalize on a particular event and the possible short span of interest in the particular topic, it has been found that the traditional methods of producing such garments and getting them to the marketplace are inadequate to meet market conditions. It thus has been found to be desirable to provide a means for producing such garments in a more expeditious manner than traditional means.

Accordingly, the principal object of the present invention is to provide a printing apparatus.

Another object of the present invention is to provide an improved apparatus for printing various designs and indicia on certain garments such as t-shirts and the like.

A further object of the present invention is to provide an improved apparatus for silk screening various designs and indicia on garments such as t-shirts, sweatshirts and other types of shirts.

A still further object of the present invention is to provide an improved apparatus for silk screening designs and indicia on garments such as t-shirts and the like which may be operated by unskilled persons.

Another object of the present invention is to provide an improved garment silk screening apparatus which is portable.

A further object of the present invention is to provide an improved garment silk screening apparatus which is simple in design, comparatively inexpensive to manufacture, relatively inexpensive to operate and highly effective in performance.

Other objects and advantages of the present invention will become more apparent to those persons having ordinary skill in the art to which the present invention pertains from the following description taken in conjunction with the accompanying drawings wherein.

Figures 1, 2:
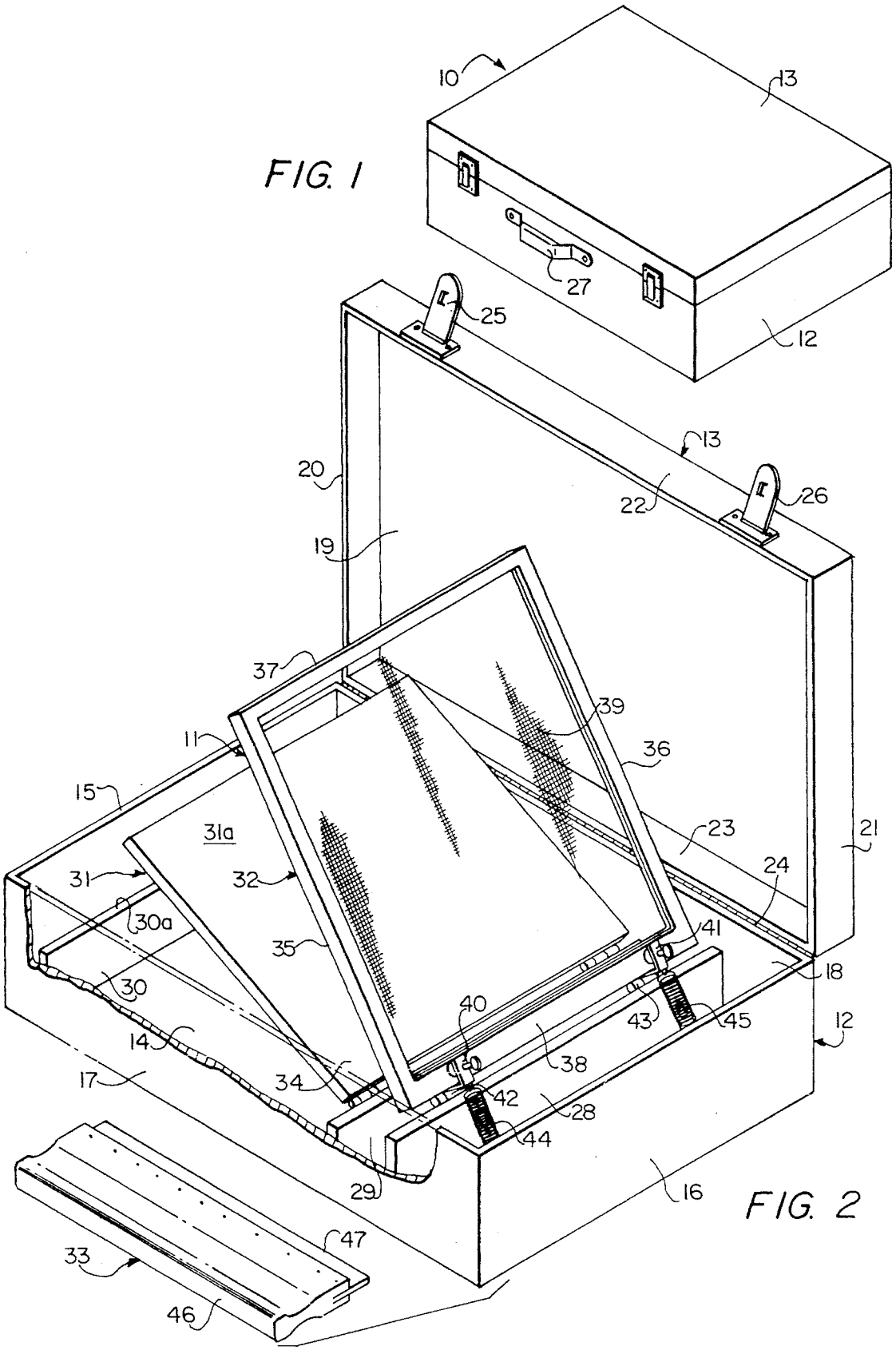
FIG. 1 is a perspective view of an embodiment of the invention shown in a closed condition suitable for transporting or storage purposes.
FIG. 2 is an enlarged perspective view of the embodiment shown in FIG. 1, illustrated in an open condition and having a portion thereof broken away.

Referring to the drawings, there is shown a garment silk screening apparatus embodying the present invention, generally including a case 10 for carrying a silk screening assembly 11. The case is of a conventional construction including a bottom member 12 and a hinged lid member 13. Bottom member 12 has a rectangular configuration and includes the bottom wall section 14, a pair of end wall sections 15 and 16 and a pair of adjoining side wall sections 17 and 18, providing an upper opening adapted to be closed by lid member 13. Lid member 13 also has a rectangular configuration and includes a top wall section 19, a pair of end wall sections 20 and 21, and a pair of side wall sections 22 and 23. As best shown in FIG. 2, side wall section 23 of the lid member is hinged to side wall section 18 of the bottom member as at 24 to allow the lid member to close on the bottom member. The lid member may be secured in the closed position by means of a pair of clasp or latch elements 25 and 26 which engage cooperating elements on side wall section 17 of the bottom member to secure the lid member in the closed position as shown in FIG. 1. In the closed position, the apparatus may be conveniently carried by means of a handle 27 provided on side wall section 17.

Provided in bottom member 12 is a set of transversely extending, vertically disposed slats 28, 29 and 30, which are adapted to support the silk screening assembly. Slat 28 is disposed adjacent but spaced from end wall section 16 and is secured along its end and bottom edges to side wall sections 18 and 19 and bottom wall section 14. Slat 28 further is disposed parallel to end wall section 16 and has a vertical dimension less than the vertical dimension of side wall sections 17 and 18. Slat 29 is disposed adjacent to but spaced from slat 28 and similarly has its end and bottom edges rigidly secured to side wall sections 17 and 18 and bottom wall section 14. Slat 29 is disposed parallel to slat 18 and end wall section 16 and has a vertical dimension less than the vertical dimension of slat 28. Slat 30 is disposed adjacent but spaced from end wall section 15 and similarly has its end and bottom edges rigidly secured to end wall sections 17 and 18 and bottom wall section 14 of the bottom case member. The vertical dimension of slat 30 is substantially the same as the vertical dimension of slat 29.

Silk screen assembly 11 includes a garment support panel member 31, a silk screen frame 32 and an ink applicator 33. Support member 31 has a rectangular configuration and is adapted to fit within bottom case member 12. Member 31 is pivotally connected along a rear edge thereof to the upper end of slat 29 by means of a hinge 34. When member 31 is pivoted downwardly into a rest position within lower case member 12, the lower front end thereof is adapted to be supported on an upper edge **30*a* of slat 30. The width and length of support panel member 31 are such so that the side edges of the panel are spaced from the side wall sections of the bottom case member and the front edge thereof is spaced from end wall section 15 when the panel member is in the lower rest position supported on the upper edge of slat 30**.

Silk screen frame member 32 includes a pair of side frame sections 35 and 36, a pair of end frame sections 37 and 38 and a silk screen 39 secured to the frame sections. The silk screen frame is adapted to be detachably mounted on slat 28 for pivotal movement relative thereto by means of a pair of C-clamps 40 and 41 pivotally mounted on the upper end of slat 28 as at 42 and 43.

Figure 3:
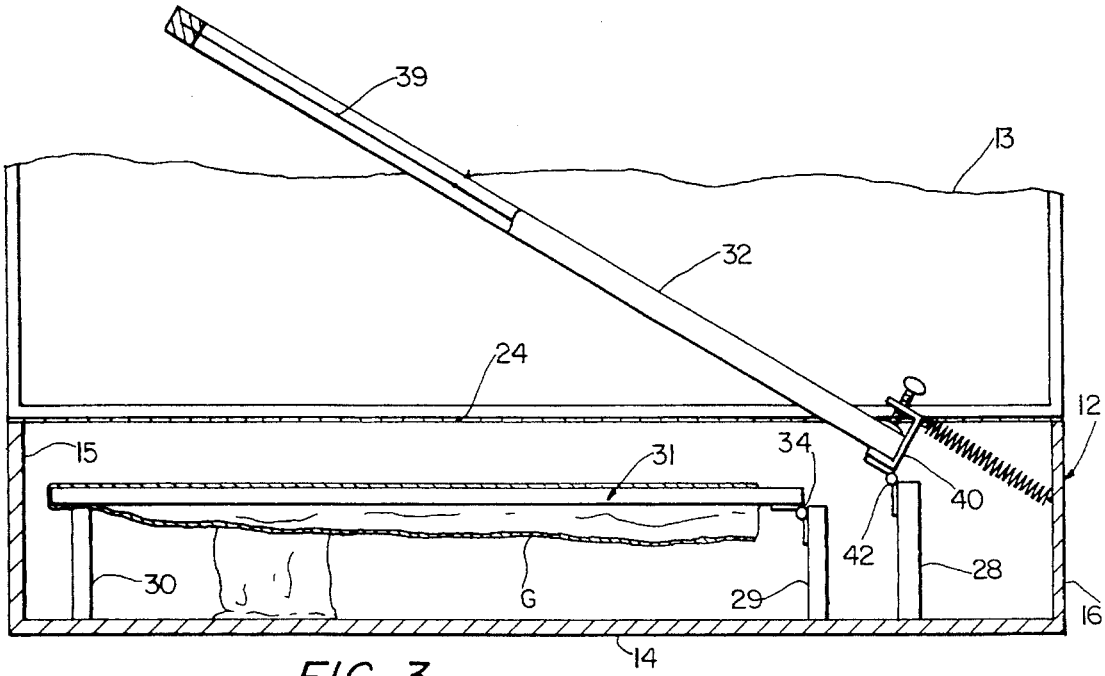
FIG. 3 is an enlarged vertical cross-sectional view of the embodiment shown in FIGS. 1 and 2.

The width and length of silk screen frame 32, the upper level of the axis of hinge elements of 42 and 43 relative to the axis of hinge 34 and the longitudinal spacing between the axes of hinge elements of 42 and 43 and hinge 34 are such so as to permit silk screen 39 to overlie upper surface 31a of panel member 31 within lower case member 12 when panel member 31 is in a lower rest position supported on upper edge **30*a* of slat 30 and frame member 32 is in a lower rest position supported on panel member 31. As best shown in FIGS. 2 and 3, C-clamps 40 and 41 are biased in an upper position by a pair of springs 44 and 45. Normally, springs 44** and 45 function to bias the silk screen frame in an upper position as shown in FIG. 2. However, when the silk screen frame is pivoted downwardly or in a counterclockwise direction relative to FIG. 3, and past an over-center position, springs 44 and 45 would be ineffective to bias the silk screen frame upwardly or in a clockwise direction. Correspondingly, when the silk screen frame is lifted and pivoted upwardly beyond such over center position, such springs will function to bias the silk screen frame in the upper position as shown in FIG. 2.

Applicator 33 is of a conventional construction consisting of a rigid handle portion 46 having a flexible wiper portion 47. Typically, the handle is made of wood or a plastic and the wiper portion is made of rubber or any other flexible material. The length of the applicator is made slightly less than the dimension of the spacing between frame sections 35 and 36 so that the wiper portion of the applicator may be inserted between frame members 35 and 36 adjacent to frame section 38 and moved toward frame section 37 to cause an amount of ink deposited on silk screen 39 adjacent frame section 38 to be spread across the silk screen and penetrate therethrough in the conventional manner.

Figure 4:
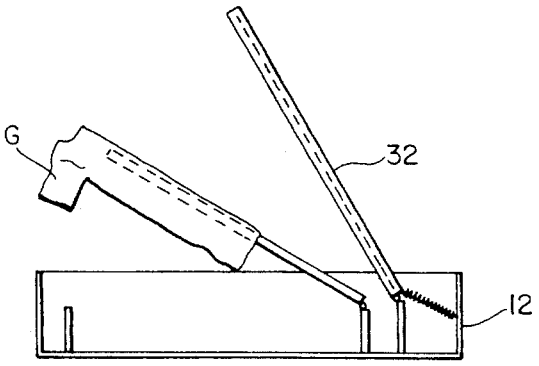
FIGS. 4 through 7 are views similar to the view shown in FIG. 3, illustrating a sequence of positions of various components of the embodiment in silk screening a garment.
Figure 5:
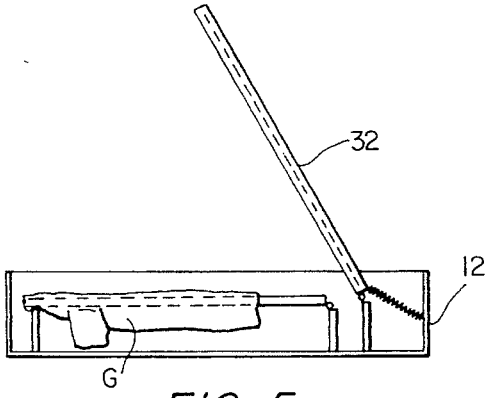
Figure 6:
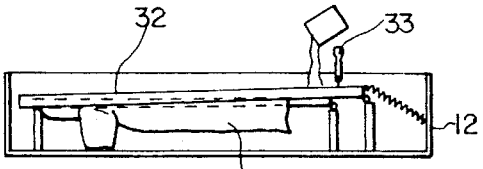
Figure 7:
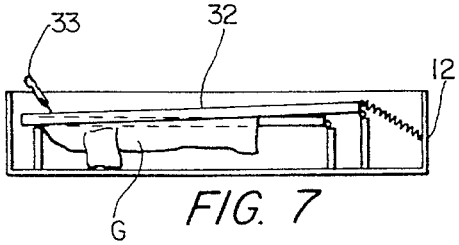

In the use of the apparatus as described to silk screen a design or indicia corresponding to a pattern provided for on silk screen 39, with the components in the positions as shown in FIG. 4, a t-shirt or similar garment is positioned on panel member 31 so that the free end of the panel member is received through the bottom opening of the garment and the portion of the garment to be printed overlies panel surface 31a facing upwardly. Panel member 31 is then pivoted downwardly to the position as shown in FIG. 5 with the free end thereof resting on slat 30. With the silk screen frame in the position as shown in FIG. 5, an amount of ink of a viscous consistency is deposited on the silk screen adjacent frame section 38. The frame section is then pivoted downwardly into a position as shown in FIG. 6 with the silk screen overlying the garment portion to be printed. The frame member will remain in such position and will not be caused to spring back by springs 44 and 45 by reason of having been moved beyond the over center position as previously described. The silk screening operation may then proceed by positioning the applicator in the position as shown in FIG. 6 and then moving it along the length of the silk screen to the position shown in FIG. 7 to spread the ink and cause it to pass through the silk screen and print a pattern on the upper panel of the garment resting on panel member 31. When the printing action has been completed, the frame member may be lifted out beyond the over-center position to cause the springs to bias the frame member into the position shown in FIG. 4 and panel member 31 may be lifted to remove the garment. The apparatus is then in a position to insert the next garment and repeat the cycle as described.

The silk screen frame member 32 is made detachable with respect to the apparatus to permit the use of different silk screen frame members having different design and indicia patterns. To remove the frame member and install a different one requires only the loosening of the C-clamps, removing the one frame member, inserting the other frame member in the C-clamps and then tightening the C-clamps.

The apparatus as described may be stored or transported merely by pivoting the garment support panel and the silk screen frame member downwardly within bottom case member 12 with panel member 31 resting on slat 30 and frame member 32 resting on panel number 31, inserting applicator 33 within bottom case member 12 and closing and securing the lid member.

The apparatus as described also may be formed of any suitable materials including metal, wood, plastics and combinations thereof. The case portion may be of a molded or fabricated construction and the silk screening components also may be constructed by any method. To further facilitate the silk screening process as described, support panel 31 also may be spring biased into an upper, garment applying position and adapted to be maintained in the lower rest position by providing a biasing arrangement in which the panel member would be in an over center position when at rest as shown in FIG. 3.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. An apparatus for silkscreening a garment comprising:

a base member;

a support panel pivotally connected along one edge thereof to said base member, having a free end thereof receivable within an opening in said garment to position a portion of said garment on an upper surface of said support panel; and a silkscreening member pivotally secured, independently of said support panel, to said base member and pivotal between an upper inoperative position and a lower operative position, having a silkscreen portion adapted to overlie said garment portion disposed on said support panel when in said operative position.

2. An apparatus according to claim 1 wherein said support panel is provided with a width and length sufficient to position said garment portion in overlying relation to said upper support surface of said support panel.

3. An apparatus according to claim 1 wherein said base member includes a lower panel, and the pivot axis of the pivotal connection between said support panel and said base member is spaced from said lower panel of said base member.

4. An apparatus according to claim 3 wherein said pivotal connection is disposed on a transversely disposed wall section of said base member.

5. An apparatus according to claim 3 wherein said base member includes a support means for supporting the free end of said support panel at a point spaced from said lower panel of said base member.

6. An apparatus according to claim 5 wherein said support means comprises a transversely disposed wall section of said base member, having an upper edge upon which the free end of said support panel is supported, when said silkscreening member is in said operative position.

7. An apparatus according to claim 3 wherein the pivot axis of said silk screening member is spaced a greater distance from said lower panel of said base member than the pivot axis of said support panel therefrom whereby when said garment is disposed on said support panel, said support panel is disposed in a rest position and said silk screening member is in said operative position, said silk screen portion of said silk screening member will overlie said garment portion to permit the application of an ink onto said silk screen and therethrough onto said garment portion.

8. An apparatus according to claim 1 wherein said silk screening member includes a base section pivotly connected to said base member and a frame section detachably mounted on said base section.

9. An apparatus according to claim 8 wherein said frame section includes a rigid, peripheral frame portion and a silk screen disposed on a bottom peripheral edge thereof.

10. An apparatus according to claim 8 wherein said base section of said silkscreening member includes at least one c-clamp adapted to receive a portion of said frame section therein.

11. An apparatus according to claim 1 including a means for biasing said silkscreen member in said inoperative position when said silkscreen member is in an over-center position disposed between said operative and inoperative positions.

12. An apparatus according to claim 1 wherein said base member includes a container having an opening in which said support panel and silkscreen member are housed, and a lid adapted to close said opening in said container to provide a portable unit.

13. An apparatus according to claim 12 wherein said container includes a first transversely disposed wall member on which said support panel is pivotally connected, a second transversely disposed wall member on which said free end of said support panel is supported when said silkscreening member is in said operative position and a third transversely disposed wall member on which said silkscreening member is pivotally connected.

* * * * *